United States Patent [19]

Ensslin et al.

[11] 4,101,775

[45] Jul. 18, 1978

[54] X-RAY TUBE CURRENT STABILIZING CIRCUIT

[75] Inventors: Frieder Hans Ensslin, Rochester; Christopher Stevens Hazen, Fairport, both of N.Y.

[73] Assignee: Sybron Corporation, Rochester, N.Y.

[21] Appl. No.: 778,558

[22] Filed: Mar. 17, 1977

[51] Int. Cl.[2] ..... H05G 1/34

[52] U.S. Cl. ..... 250/409; 315/101

[58] Field of Search ..... 250/409, 403, 402; 315/101

[56] References Cited

U.S. PATENT DOCUMENTS

| | | | |
|---|---|---|---|
| 2,617,045 | 11/1952 | Coe | 250/409 |
| 2,810,838 | 10/1957 | Clapp et al. | 250/409 |
| 3,527,947 | 9/1970 | Weisglass et al. | 250/402 |

*Primary Examiner*—Alfred E. Smith
*Assistant Examiner*—T. N. Grigsby
*Attorney, Agent, or Firm*—Theodore B. Roessel; J. Stephen Yeo

[57] ABSTRACT

A power supply for self-rectifying X-ray tubes controls filament current inversely to tube current. Although the tube current is passed only during alternate half cycles provision is made for symmetrical control of the filament current.

1 Claim, 4 Drawing Figures

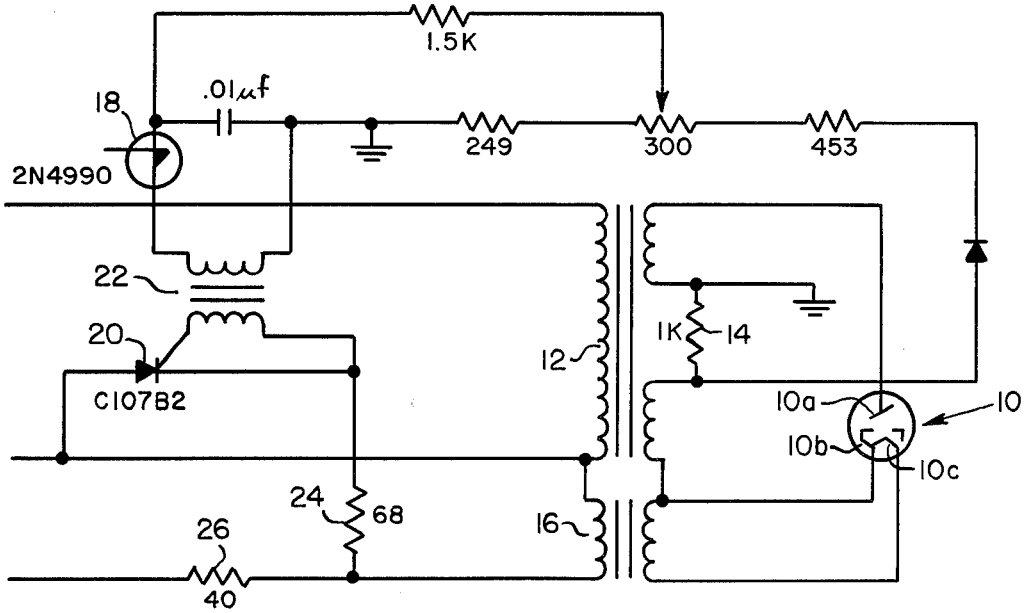
FIG. 1 (PRIOR ART)
FIG. 2
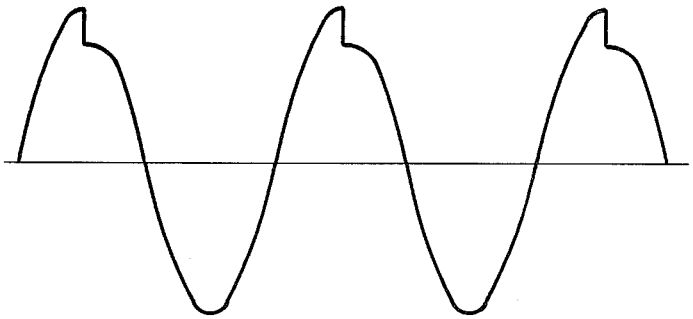
FIG. 4
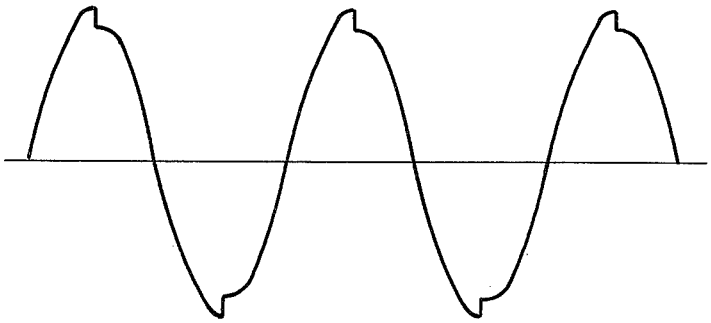

X-RAY TUBE CURRENT STABILIZING CIRCUIT

BACKGROUND OF THE INVENTION

This invention pertains to power supplies for X-ray tubes and more particularly concerns circuitry for stabilizing X-ray tube current.

X-ray tubes are commonly of Collidge type which is a diode having a thermonic cathode which emits electrons, at least some of which strick an anode called a plate. The plate emits X-ray radiation, the intensity of which being dependant upon the voltage imposed across cathode and plate (tube voltage) and the current between cathode and plate (tube current). The thermonic cathode is heated by a filament. A factor affecting tube current is filament temperture which corresponds to filament current. The higher the filament current, the higher will be the tube current. A number of circuits are known which cause the filament current to respond inversely to tube current so as to maintain a constant tube current regardless of moderate fluctuations in line voltage.

An example of a known circuit is illustrated in FIG. 1 which is labeled "Prior Art". Connected across the plate 10*a* and cathode 10*b* of X-ray tube 10 is the high voltage output of transformer 12. The input of transformer 12 is driven by alternating line voltage. The tube 10 is a half wave rectifier as it only passes tube current during alternate half cycles. The voltage drop across a series resistor 14 is proportional to tube current. This waveform is shown in FIG. 2 and identified as tube current signal.

Tube filament 10*c* is heated by filament current supplied by a low voltage filament transformer 16 driven by line voltage through control circuitry. Uncontrolled filament current is a full wave sinusoid.

A sample of the tube current signal is connected across a trigger diode 18 or silicon unilateral switch or the like. When the signal exceeds a threshold the diode 18 triggers a controlled rectifier 20 on by passing a trigger signal through an isolation transformer 22. When the controlled rectifier 20 is on, it shunts a resistor 24 across the input of filament transformer 16. Resistor 24 and resistor 26 forms a voltage divider with transformer 16, resulting in lower input voltage to transformer 16 and corresponding lower filament current. The controlled rectifier 20 remains closed until the end of the particular half cycle.

This scheme controls tube current by monitoring tube current. When the tube current exceeds a predetermined value the filament current is lowered for the remainder of the half cycle so as to maintain constant tube current even with moderate variations of line voltage.

The waveform of the controlled filament current is shown in FIG. 2. It is seen that since the controlled rectifier only regulated during the half cycle when the tube is conducting the filament current is unsymmetrical. This has the undesirable effect of providing a direct current bias which may saturate the filament transformer.

SUMMARY OF THE INVENTION

A power supply controls the filament current of an X-ray tube in response to current flowing through the tube. The tube current is a rectified half wave, but the filament current is symmetrically controlled during both halves of an alternating cycle. One way to accomplish this is to reduce the filament current for equal portions of each half cycle by means which includes a half cycle delay.

BRIEF DESCRIPTION OF THE DRAWINGS

FIG. 1 is a circuit known in the prior art;

FIG. 2 represents waveforms of signals in the circuit of FIG. 1;

FIG. 4 represents a waveform of filament current controlled by the circuit of FIG. 3.

DESCRIPTION OF THE PREFERRED EMBODIMENT

Figure 3:
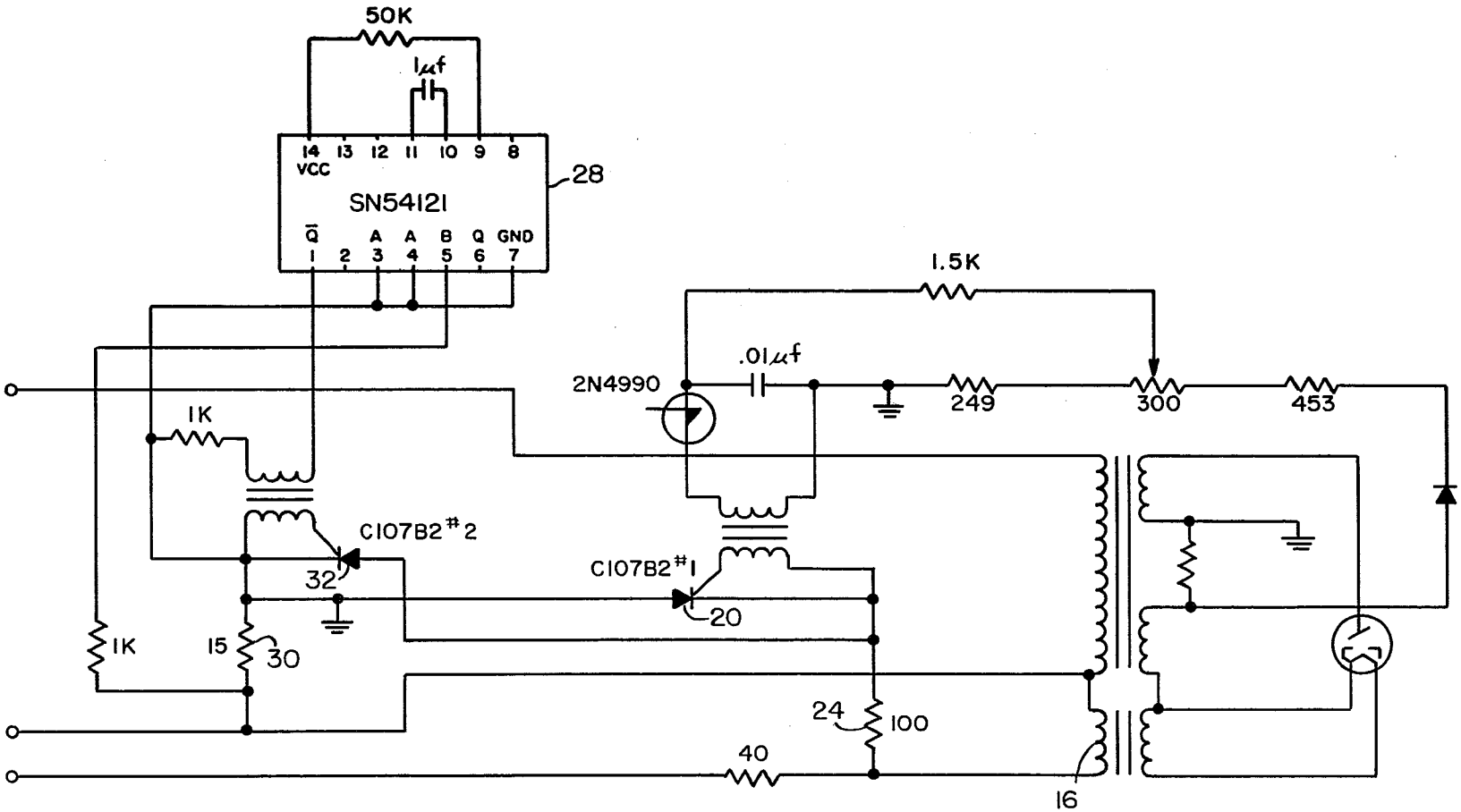
FIG. 3 is a circuit embodying the present invention.

Familiarity of FIGS. 1 and 2, described in the "Background of the Invention", is necessary for an understanding of this embodiment. The practice of this invention provides a symmetrical filament current waveform compared to the unsymmetrical waveform of the prior art.

We refer now to FIG. 3 which represents the preferred embodiment of our invention. Those elements which correspond to those in FIG. 1 have been assigned the same identifying numbers and perform the same functions except when so noted. Furthermore, appropriate component values and types are indicated, but as an aid only, not as limitations.

As previously described trigger diode 18 provides a trigger signal to control rectifier 20 now referred to as the first controlled rectifier 20. As a feature of the invention the trigger voltage also starts a timer 28. One way we prefer to do this is to provide a series resistor 30 in series with the first controlled rectifier 20.

When first controlled rectifier 20 is triggered on a voltage appears across resistor 30 and starts timer 28 running. Timer 28 is arranged to provide a second trigger signal one-half cycle after the first trigger signal. The second trigger signal is used to switch on a second controlled rectifier 32 which is shunt with the first controlled rectifier 20.

In keeping with invention resistor 24 is switched in shunt with filament transformer 16 for a portion of each half cycle, not just alternate half cycles as in the prior art.

The waveform of the resulting filament current is seen in FIG. 4. As seen it is symmetrical which prevents possible DC saturation of filament transformer 16. Less reduction in filament current is needed as both halves of a cycle is used. Accordingly resistor 24 may be made higher value.

Having described our invention, we claim:

1. For use with a rectifying X-ray tube, a power supply providing stabilized tube current by controlling the current through a filament comprised of:

a high voltage source for providing tube voltage;

a resistor in series with said high voltage source and said tube for producing a current signal voltage corresponding to the tube current;

trigger means for providing a first trigger signal when the current signal voltage exceeds a predetermined value;

a current reducing circuit switchably connected to said filament;

first switching means for connecting said current reducing circuit to the filament upon receipt of said first trigger signal until the end of the then occurring half cycle, timer means for providing a delayed second trigger signal delayed one half cycle after the trigger signal, and second switching means for connecting said current reducing circuit to the filament upon the receipt to the second trigger signal until the end of the then occurring half cycle.

* * * * *